United States Patent [19]

Nagel

[11] 4,165,833

[45] Aug. 28, 1979

[54] AUTOMATIC FLUE DAMPER

[75] Inventor: George W. Nagel, Forest Hills, Pa.

[73] Assignee: Westinghouse Electric Corp., Pittsburgh, Pa.

[21] Appl. No.: 891,674

[22] Filed: Mar. 30, 1978

[51] Int. Cl.[2] ..... F23N 3/00

[52] U.S. Cl. ..... 236/1 G; 236/93 R; 236/101 D; 431/20

[58] Field of Search ..... 236/1 G, 93 R, 101 D, 236/16, 49; 431/20; 126/285 R; 137/468; 98/40 UT

[56] References Cited

U.S. PATENT DOCUMENTS

| | | | |
|---|---|---|---|
| 1,659,875 | 2/1928 | Jacobs | 236/93 |
| 2,154,644 | 4/1939 | Sweatt | 431/20 |
| 2,284,674 | 6/1942 | Murdock | 237/2 |
| 2,508,885 | 5/1950 | Mackay | 431/20 |
| 3,366,333 | 1/1968 | Diehl | 236/93 R |
| 3,934,796 | 1/1976 | Smith, Jr. et al. | 431/20 X |
| 4,046,318 | 9/1977 | Ripley | 236/1 G |
| 4,079,884 | 3/1978 | Sherman | 236/1 G |

FOREIGN PATENT DOCUMENTS

| | | | |
|---|---|---|---|
| 822,480 | 10/1959 | United Kingdom | 236/93 |

*Primary Examiner*—William E. Wayner
*Assistant Examiner*—William E. Tapolcai, Jr.
*Attorney, Agent, or Firm*—E. C. Arenz

[57] ABSTRACT

A relatively simple automatic mechanical flue damper is provided by a damper plate having a slot extending across a major portion of its diameter with a helically-shaped, temperature responsive bimetal having one end attached to the damper plate at one end of the slot, and its other end attached to a bushing which in turn is fixed relative to the flue in which the damper is situate, with a shaft extending in rotatable relation through a bore in the bushing and having its end opposite the bushing attached to the damper plate, the helical bimetal being responsive to changes in flue gas temperature to rotate the damper plate between predetermined open and closed positions with the shaft rotating to corresponding positions, and at least one of the shaft ends including indicia means to permit observation of shaft and damper rotative position.

The arrangement adapts itself to the provision of electrical means responsive to the shaft rotation to shut down the furnace operation in response to failure of the damper plate to move the open position within a predetermined time after initiation of the furnace operation.

4 Claims, 3 Drawing Figures

AUTOMATIC FLUE DAMPER

BACKGROUND OF THE INVENTION

1. Field of the Invention

The invention pertains to the art of automatic flue dampers for furnace exhaust gas flues, and in particular to the type in which the damper plate is mechanically actuated in response to changes in the flue gas temperatures.

2. Description of the Prior Art

Automatic flue dampers are arranged to be actuated in a number of different ways. These ways include electric motors, solenoids, pneumatic or hydraulic actuation, as well as using the thermal expansion or vaporization of various solids or liquids to position the flue damper. Additionally it has been proposed to use bimetal actuated arrangements which include at least one arrangement in which four bimetal pieces arranged in quadrants in the flue obstruct the flue gas and then bend out of the gas path when they are heated by the gas. Another bimetal actuated arrangement shown in U.S. Pat. No. 3,366,333 uses a bimetal spiral which operates a flue damper between open and closed positions.

The non-bimetal type arrangements require a fair degree of mechanical complexity, particularly in that the arrangements require, to be fail-safe, that the dampers open even if hot gases reach them unaccompanied by an electrical command to open. The prior art bimetal design in which quadrants of bimetal are used as somewhat complex in that each of the quadrants of the flue must have its own bimetal flapper and this requires a significant amount of bimetal material to cover the flue area. Furthermore this quadrant type design does not lend itself to furnishing an external indication of the position of the bimetals in the flue and it is also not convenient from outside the flue pipe to force or hold open this style of damper.

As to the noted patented bimetal actuated arrangement, this arrangement is considered deficient with respect to mine in that it requires the use of a fixed shaft which precludes the external indication of the damper position, and the bimetal in a spiral conformation does not provide as good thermal interaction between the bimetal and flue gas since the outer spiral parts tend to block the quick heat transfer to the inner spiral material. The arrangement also requires the provision of a frame within the flue with two integral offset semi-circular portions to serve as stops for the damper.

The use of a helical bimetal, is distinguished from a spiral bimetal, and which is responsive to changes in temperature is shown in U.S. Pat. No. 2,284,674. This arrangement is shown in conjunction with a hot air furnace in which the damper is in the supply duct from the furnace to the rooms, as distinct from in the furnace flue which receives the exhaust gases. The arrangement there shown is also considered to have mechanical and assembly complexities in comparison to the relatively simple and inexpensive arrangement of my invention.

SUMMARY OF THE INVENTION

In accordance with my invention the flue damper for the furnace exhaust gas flue includes a shaft extending diametrically through the flue with its opposite ends projecting beyond the flue, a bushing having a bore therein receiving the shaft in rotatable relation, a damper plate which has an open slot extending across the major part of its diameter and including means formed in the damper plate at the one end of the slot to receive and secure in non-rotatable relation an end portion of the shaft, and means formed in the damper plate at the other end of the slot receiving the bushing in rotatable relation therein, a helically-shaped bimetal strip situate in the slot and extending from end to end thereof with the bimetal having one end secured to the damper plate adjacent the location of securement of the plate to the shaft and having its other end secured to the bushing, means securing the bushing to the flue in fixed relation, damper stop means comprising interacting means on the damper plate and the bushing to limit movement of the damper plate between predetermined open and closed positions, the bimetal being responsive to changes in flue gas temperature to rotate the damper plate between the predetermined open and closed positions with the shaft rotating to corresponding positions, and at least one of the shaft ends including indicia means to permit observation of the shaft and damper rotative position.

In what is believed to be the currently preferred arrangement, there is also provided electrical means responsive to the shaft rotation to shut down furnace operation in response to failure of the damper plate to move to the predetermined open position within a predetermined time after initiation of the furnace operation.

DRAWING DESCRIPTION

Figures 1, 2, 3:
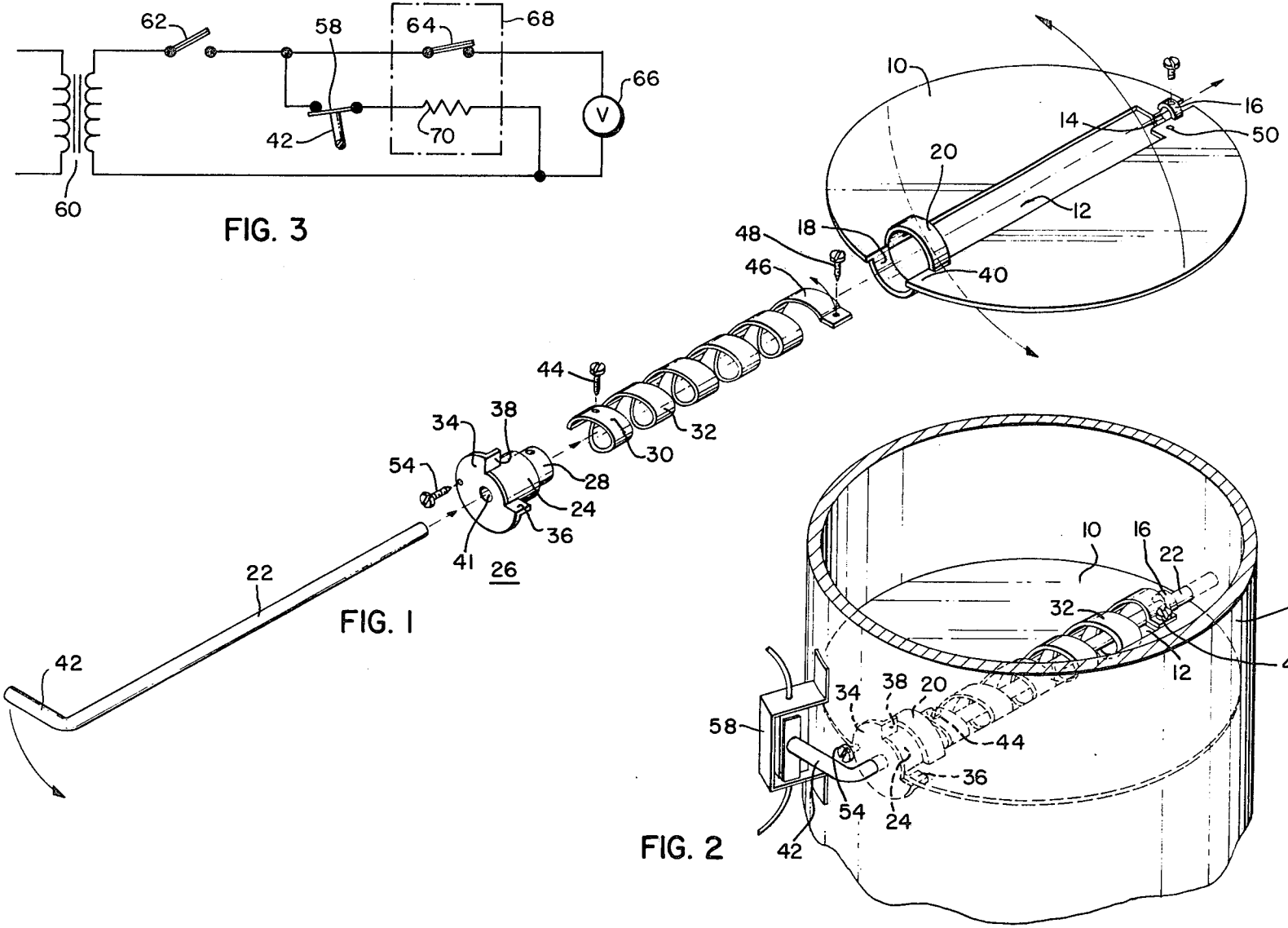
FIG. 1 is an exploded isometric view of the major parts of the damper assembly with the flue pipe omitted.
FIG. 2 is a partly broken view of the parts in assembled relation and installed in a flue pipe.
FIG. 3 is an electrical schematic view of the arrangement for insuring a furnace shutdown in the event the damper plate should fail to open within a predetermined time.

Referring to FIGS. 1 and 2, the one piece, generally circular damper plate 10 is provided with an open slot 12 extending across the major part of its diameter with a pair of oppositely open, small, half circle elements 14 and 16 being formed in the damper plate at the one end of the slot 12, and another pair of oppositely open, larger, half circle elements 18 and 20 being formed in the damper plate at the other end of the slot 12. The diameter of the circle formed by the two oppositely open small circle elements corresponds to the diameter of the shaft 22, one end portion of which is received in the circle and secured to the damper plate in the final assembly of the arrangement. The larger half circles form a complete circle having a diameter slightly larger than the intermediate part 24 of the bushing generally designated 26, the intermediate part 24 being received in rotatable relation within the larger circle in the final assembly.

Besides the intermediate part 24 of the bushing which is rotatably received in the two large half circles, the bushing includes a smaller diameter cylindrical part 28 to which the one end 30 of the corresponding diameter helical bimetal 32 is attached, and an enlarged flanged end 34 of the bushing which is adapted to be attached in fixed relation to a side wall of the flue. The bushing flange 34 has a cutout portion extending through approximately 90° with a tab 36 and 38 at each end of the arc of the cutout. As best seen in FIG. 1, the larger half circle element 18 is inset from the periphery of the circular disk damper plate so that a shoulder or corner 40 of the damper plate is in a position to be stopped by the tabs 36 and 38 as the damper plate is moved through its approximately 90° arc between predetermined open and closed positions. The bushing 26 is also provided with a central bore 41 having a diameter slightly larger than the diameter of the shaft 22 to rotatably receive the shaft therethrough.

The shaft 22 as shown is provided with a right angle end 42 which may serve as an indicia of the rotative position of the damper plate and shaft in the assembled relation, or which may be used to operate an electric interlock as will be later explained. It will be appreciated that the shaft may simply by straight with means provided at the one end to provide the indicating flag or operating lever in other conformations.

The manner in which the assembly of the parts proceeds is as follows. The end 30 of the helically-shaped bimetal 32 is fastened to the small diameter part 28 of the bushing as with a screw fastener 44. The bimetal and bushing are inserted through the large half circle elements and into the slot 12 of the damper plate, and the right-hand end 46 of the bimetal in FIG. 1 is attached to the damper plate with a screw fastener 48 or other suitable means at the location 50 on the damper plate adjacent the small half circle elements. This subassembly is now positioned in a short flue section 52 (FIG. 2) and bushing 26 is fixed to the flue wall by a fastener 54 or other suitable means with the stop arrangement 36 and 38 being properly oriented to provide for the damper to be movable between the predetermined open and closed positions. The shaft 22 is then inserted through a hole in the flue wall, through the bore 41 of the bushing 36, through the interior open part of the bimetal, through the small half circles 14 and 16, and out an opening on the opposite side of the flue wall. The shaft 22 is then fixed with respect to the rotative position of the damper plate by means of a fastener 56 or other suitable means to insure that the indicia means at the one end of the shaft indicates the damper rotative position. In some cases it may be preferable to form the half circle elements and the corresponding end of the damper shaft in a non-circular configuration to promote the alignment and insure the retention of the shaft end in a particular non-rotative position relative to the damper plate elements receiving the shaft end.

The parts in their assembled relation are best seen in FIG. 2 which also shows the provision of electrical means responsive to shaft rotation for the purpose of shutting down the furnace operation in response to a failure of the damper plate to move to a predetermined open position within a predetermined time after initiation of the furnace combustion. In this arrangement, a microswitch 58 is shown mounted to the outside of the flue in a position that the lever end 42 of the shaft will hold the microswitch in a closed position so long as the lever arm is in a position indicating that the damper plate is closed in the flue.

The circuit arrangement for this control is illustrated schematically in FIG. 3 in which the low voltage control power derives from the transformer 60, one side of which is connected to the room thermostat 62 which in turn is connected in parallel to one side of the microswitch 58 and to one side of a normally closed bimetal switch 64. The switch 64 has its other side connected to the fuel valve 66 or similar fuel providing device such as an oil burner pump. The bimetal switch 64 is part of a time delay component 68 which also includes a resistance heater 70 in series with the switch 58.

The way in which the circuit operates is that with a demand for heat from the room the room thermostat 62 closes, which in turn energizes the gas valve 66 through the closed bimetal switch 64. Concomitantly, the heater 70 is energized since the damper plate 12 is closed and the shaft lever arm 42 accordingly holds the microswitch 58 closed. In normal operation, as the heat is produced in the combustion chamber the bimetal 32 will respond thereto and operate the damper in an opening position so that the lever 42 of the shaft 22 turns and permits the switch 58 to open and deenergize the time delay heater 70. The heater 70 is sized so that in normal operation of the furnace the rate of its heat emission is sufficiently slow that the bimetal switch or otherwise heat responsive switch 64 will remain closed sufficiently long that the damper plate will move toward a sufficiently open position before the bimetal 64 responds to the heat and opens the circuit to the gas valve 66. However, should combustion fail to occur so that the damper plate does not open, the shaft will remain in a position keeping the heater 70 energized and the opening of the bimetal 64 will deenergize the gas valve and stop the admission of gas to the combustion chamber.

It is pointed out that with the arrangement of the invention, the arrangement takes relatively simple parts and is readily assembled to the flue. The provision of the helical bimetal extending throughout the length of the slot over a major portion of the diameter of the flue insures that there will be good thermal interaction between the heat from the combustion products and the bimetal as well as making it responsive even if there tends to be localized flow in the flue.

I claims:

1. A flue damper arrangement for furnace exhaust gas flue comprising:
   - a shaft extending diametrically through said flue with its opposite ends projecting beyond said flue;
   - a bushing;
   - a damper plate having an open slot extending across the major part of its diameter and including means formed in said damper plate at one end of the slot receiving and securing in non-rotatable relation an end portion of said shaft, and means formed in said damper plate at the other end of said slot receiving said bushing in rotatable relation therein;
   - said bushing having a bore receiving said shaft therein in rotatable relation;
   - a helically-shaped bimetal strip situate in said slot and extending from end to end thereof, said bimetal having one end secured relative to said damper plate adjacent the location of securement of said plate to said shaft, and having its other end secured to said bushing;
   - means securing said bushing to said flue in fixed relation;
   - damper stop means comprising interacting means on said damper plate and said bushing to limit movement of said damper plate between predetermined open and closed positions;
   - said bimetal being responsive to changes in flue gas temperature to rotate said damper plate between said predetermined open and closed positions with said shaft rotating to corresponding positions; and
   - at least one of said shaft ends including indicia means to permit observation of shaft and damper rotative position.

2. An arrangement according to claim 1 including:

electrical means responsive to shaft rotation to shut down furnace operation in response to failure of said damper plate to move to said predetermined open position within a predetermined time after energization of means for initiating furnace combustion.

3. An arrangement according to claim 2 wherein:

said electrical means includes first switch means having one position corresponding to said predetermined damper closed position and another position corresponding to said predetermined damper open position; and said arrangement includes a second normally-closed switch in series with a room thermostat switch and a fuel supply device, said second switch operating to an open position in response to closure of said room thermostat switch and the failure of said first switch to operate from said one to said another position within a predetermined time.

4. An arrangement according to claim 3 wherein:

said second switch is temperature responsive; and heater means is connected to said first switch and is associated with said second switch in heat transfer proximity.

* * * * *